US009783333B1

(12) United States Patent
De Los Santos et al.

(10) Patent No.: US 9,783,333 B1
(45) Date of Patent: Oct. 10, 2017

(54) POST CONSTRUCTION AND TIERED PALLETIZABLE CONTAINER COMPRISING SUCH POSTS

(71) Applicant: Packaging Corporation of America, Lake Forest, IL (US)

(72) Inventors: George De Los Santos, Los Angeles, CA (US); Craig Smith, Los Angeles, CA (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 15/008,204

(22) Filed: Jan. 27, 2016

Related U.S. Application Data

(60) Provisional application No. 62/108,434, filed on Jan. 27, 2015.

(51) Int. Cl.

| | |
|---|---|
| ***A47G 29/00*** | (2006.01) |
| ***A47F 5/00*** | (2006.01) |
| ***A47B 43/00*** | (2006.01) |
| ***A47B 47/00*** | (2006.01) |
| ***A47B 57/00*** | (2006.01) |
| ***B65D 5/00*** | (2006.01) |
| ***A47B 96/14*** | (2006.01) |
| ***B65D 5/44*** | (2006.01) |
| ***A47F 5/11*** | (2006.01) |

(52) U.S. Cl.
CPC ..... *B65D 5/006* (2013.01); *A47B 96/14* (2013.01); *A47F 5/112* (2013.01); *B65D 5/445* (2013.01)

(58) Field of Classification Search
CPC ..... B65D 5/006; B65D 5/0065; B65D 5/005; B65D 5/00; B65D 5/445; A47F 5/112; A47F 5/11; A47F 5/114; A47F 5/116; A47F 5/118; A47B 43/02; A47B 47/06; A47B 55/06; A47B 61/06; A47B 96/14; A47B 96/1433; A47B 96/145; A47B 87/02; A47B 87/0207; A47B 87/0261; A47B 87/0269; A47B 47/0091
USPC ..... 211/72, 153, 135, 188, 194, 73; 248/176.1, 152, 174, 300; 206/176, 175, 206/179, 193, 511, 509, 821, 60; 229/918, 919, 199; 108/156
See application file for complete search history.

(56) References Cited

U.S. PATENT DOCUMENTS 3,129,868 A 4/1964 Jenk
3,141,554 A 7/1964 Sussman et al.
3,226,008 A * 12/1965 Chiorri ..... B65D 5/006 217/69

(Continued)

*Primary Examiner* — Jennifer E Novosad
(74) *Attorney, Agent, or Firm* — Klarquist Sparkman, LLP

(57) ABSTRACT

A post for supporting trays of a container comprises a plurality of panel sections including a first panel section. The panel sections form first and second corners positioned adjacent to one side surface of the first panel section and that end up at the interior of the post. The upper trays are desirably supported by the interior corners and also by portions of the panel sections that form the interior corners and by a portion of the first panel section to thereby enhance the support provided to the upper trays. Two of the posts can be positioned together in face to face relationship to form a center post for supporting upper trays. Selected panel sections desirably have upwardly extending locking tabs and cross member support receiving slots. Containers comprising plural trays and such posts are also described.

24 Claims, 14 Drawing Sheets

(56) References Cited

U.S. PATENT DOCUMENTS

RE27,200 E * 10/1971 Ferdinand et al. .... A47B 96/14 108/107
3,683,822 A * 8/1972 Roberts ..... B65D 19/0095 108/51.3
3,834,324 A 9/1974 Lang
4,102,276 A * 7/1978 Roveroni ..... A47B 47/06 108/156
4,248,350 A * 2/1981 Gilbert ..... B65D 5/5033 206/320
4,292,901 A * 10/1981 Cox ..... B65D 71/0096 108/55.1
4,333,622 A * 6/1982 Albano ..... A47B 65/00 108/165
4,351,246 A * 9/1982 Hutchins, Jr. ..... A47B 47/06 108/156
4,433,788 A 2/1984 Erlam et al.
4,546,941 A * 10/1985 Hildebrand ..... A47C 5/005 108/115
4,579,233 A 4/1986 Hepp
4,638,745 A * 1/1987 Sheffer ..... A47F 5/112 108/156
5,339,746 A * 8/1994 Vannatta ..... B65D 19/0012 108/51.3
5,423,270 A * 6/1995 Kilpatrick ..... B65D 19/0012 108/51.3
5,996,510 A * 12/1999 Harpman ..... B65D 19/0012 108/51.3
6,119,875 A * 9/2000 Smith ..... A47F 5/0815 211/195
6,135,033 A * 10/2000 Deferrari ..... A47F 5/116 108/165
6,357,587 B1 * 3/2002 Melms, Jr. ..... B65D 85/64 206/320
6,378,764 B1 * 4/2002 Teixidor Casanovas ..... B65D 5/0065 206/509
6,513,662 B1 * 2/2003 Stebelton ..... B65D 81/054 206/586
6,520,336 B2 * 2/2003 Baechle ..... B65D 81/053 206/320
7,066,342 B2 6/2006 Baechle
7,111,735 B2 * 9/2006 Lowry ..... B65D 5/52 206/586
7,137,517 B2 * 11/2006 Lowry ..... B65D 21/0215 206/586
7,281,648 B2 10/2007 Lowry
7,625,616 B2 * 12/2009 Van de Camp ..... B65D 81/053 206/586
8,297,492 B2 * 10/2012 Muyskens ..... B65D 5/5033 220/646
8,317,039 B2 * 11/2012 Norman ..... A47B 87/0261 211/60.1
8,833,573 B2 * 9/2014 Tomaszewski ..... B65D 19/385 108/186
9,185,984 B2 * 11/2015 Henke ..... A47B 47/0008
9,428,298 B2 * 8/2016 Bersamin ..... A47F 5/114
9,511,920 B2 * 12/2016 Baker ..... B65D 81/054
2002/0088378 A1 * 7/2002 Simms ..... B65D 19/0012 108/51.3
2003/0111383 A1 * 6/2003 Qiu ..... B65D 81/054 206/586
2006/0108408 A1 * 5/2006 Lowry ..... B65D 5/321 229/199
2006/0151410 A1 * 7/2006 Lowry ..... A47F 3/142 211/126.16
2008/0135698 A1 6/2008 Gordon
2009/0032432 A1 2/2009 Kostos et al.
2013/0008865 A1 1/2013 Su
2015/0122694 A1 * 5/2015 Hession ..... A47F 5/11 206/563

* cited by examiner

POST CONSTRUCTION AND TIERED PALLETIZABLE CONTAINER COMPRISING SUCH POSTS

CROSS REFERENCE TO RELATED APPLICATION

This application claims the benefit of U.S. Provisional Application Ser. No. 62/108,434, entitled POST CONSTRUCTION AND TIERED PALLETIZABLE CONTAINER COMPRISING SUCH POSTS, filed on Jan. 27, 2015.

TECHNICAL FIELD

This disclosure relates to product containers and more specifically to tiered palletizable containers with posts that separate the layers or container tiers from one another as well as supporting the tiers above the posts.

BRIEF DESCRIPTION OF THE DRAWINGS

FIG. 5 also shows two such posts positioned at the center of the tray to form an exemplary center post and cross member supports extending from the corners to the center post. FIG. 5 also shows exemplary side supports that can be positioned at locations intermediate to the corner posts and along the sides of the tray to provide additional structural support for a loaded tray above the illustrated tier, for example during transportation of the assembled container with product contained therein.

SUMMARY

Figure 1:
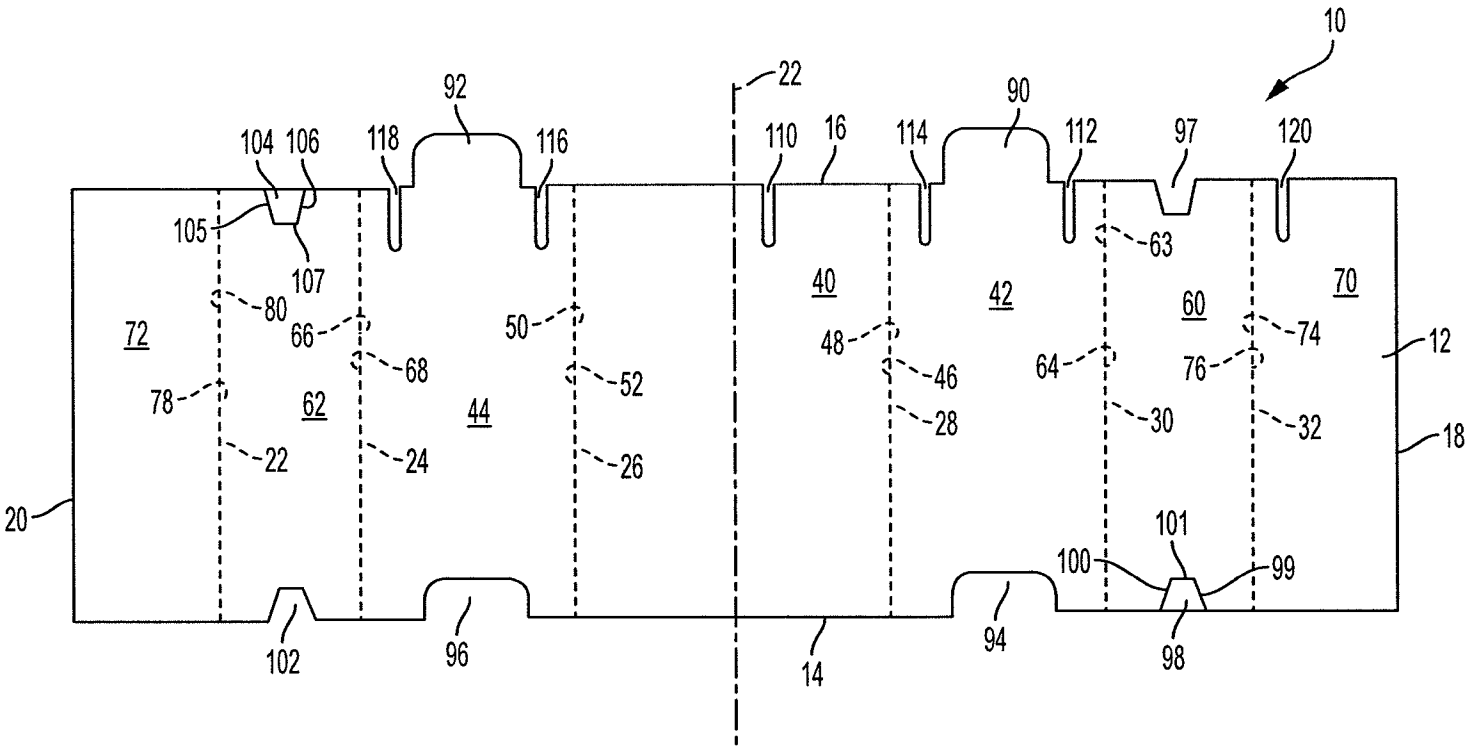
FIG. 1 is a plan view of an exemplary blank that can be used for forming one form of a post in accordance with this disclosure.

In accordance with aspects of embodiments disclosed herein, a post for supporting trays of a container comprises a plurality of panel sections including a first or face panel section. The panel sections form first and second corners that are desirably positioned adjacent to one side surface of the first panel section and that end up at the interior of the post. The interior corners are desirably part of respective first and second tubular structures, that can be triangular, rectangular of or another cross section. The upper trays are desirably supported at least in part by the interior corners and also by portions of the panel sections that form the interior corners and by a portion of the first or face panel section to thereby enhance the support provided to the upper trays. Two of the posts can be positioned together, desirably in face to face relationship, so as to form a center post for supporting upper trays. Selected panel sections desirably have upwardly extending locking tabs and cross member support receiving slots. Containers comprising plural trays and such posts are also described.

In accordance with an embodiment, a post for supporting trays of a container comprises: a first panel section having first and second ends and first and second opposed sides, the first side comprising a first side surface and the second side comprising a second side surface; a first tubular structure positioned at the first side of the first panel section; a second tubular structure positioned at the first side of the first panel section and adjacent to the first tubular structure; the first tubular structure comprising second and third panel sections that meet at a first corner, the first corner being positioned along a central portion of the first side panel section and adjacent to the first side surface of the first panel section; and the second tubular structure comprising fourth and fifth panel sections that meet at a second corner, the second corner being positioned along a central portion of the first side of the first panel section and adjacent to the first side surface of the first panel section and wherein the third and fifth panel sections extend away from the first side surface of the first panel section. These tubular structures can be triangular in transverse cross section or have another transverse cross sectional shape.

As further aspects of embodiments, the second and fourth panel sections can each abut the first side surface and the third and fifth panel sections abut one another. In addition, the post can comprise at least one cross member receiving slot in the first end of the first panel section and at least one cross member receiving slot in the second panel section, the cross member receiving slots being aligned and positioned so as to receive one leg portion of an angular cross member having first and second leg portions with the second leg portion of the cross member overlaying and being supported by the first and second corners and the third and fifth panel sections.

As other aspects of embodiments, a post can be comprised of first and second posts as described above with the second side surface of the first panel section of the first post positioned against the second side surface of first panel section of the second post.

As still further aspects of embodiments, the post can comprise a structure wherein the second panel section is joined to the third panel section at the first corner along a first fold line, the fourth panel section is joined to the fifth panel section at the second corner along a second fold line, the post comprising sixth and seventh panel sections, the first panel section comprising first and second side edges, the sixth panel section being joined to the third panel section along a third fold line at a third corner and being joined to the first side edge of the first panel section along a fourth fold line at a fourth corner, and the seventh panel section being joined to the fifth panel section along a fifth fold line at a fifth corner and being joined to the second side edge of the first panel section along a sixth fold line at a sixth corner. In addition, the post has upper and lower ends when in use, the first end of the first panel section being at the upper end of the post when in use, each of the sixth and seventh panel sections including upwardly extending locking tabs. In addition, the sixth panel section can include first and second cross member receiving slots positioned at opposite sides of the locking tab of the sixth panel section, and the seventh panel section can include first and second cross member receiving slots positioned at opposite sides of the locking tab of the seventh panel section.

The posts are desirably formed of a single unitary sheet of corrugated paperboard.

In accordance with embodiments, a post for supporting trays of a container can comprise: a plurality of elongated panel sections, the post having an interior and an exterior, each panel section having respective upper and lower ends when the post is in use, the panel sections comprising opposed first and second surfaces, the panel sections including at least one face panel section, the first surface of the face panel section facing toward the interior of the post and the second surface of the face panel section facing away from the interior of the post, the panel sections forming at least first and second interior post corners positioned interiorly of the first surface of the face panel section; the panel sections can comprise second and third panel sections that meet at the first interior post corner; the panel sections comprising fourth and fifth panel sections that meet at the second interior post corner; and the second and fourth panel sections can each be positioned adjacent to the first side surface of the first panel section and the third and fifth panel sections can extending away from the first side surface of the first panel section. In addition, the first interior post corner can be positioned along a central portion of the first side of the first panel section and adjacent to the first side surface of the first panel section, and the second interior post corner can be positioned along a central portion of the first side of the first panel section and adjacent to the first side surface of the first panel section.

In accordance with further aspects of embodiments, the second and fourth panel sections of the post can abut the first surface of the first panel section and the third and fifth panel sections can abut one another. In addition, the post can be constructed such that the second panel section is joined to the third panel section along a first fold line, wherein the second and third panel sections are folded at the first fold line to form the first interior post corner, the fourth panel section is joined to the fifth panel section along a second fold line, wherein the fourth and fifth panel sections are folded at the second fold line to form the second interior post corner, the post comprising sixth and seventh panel sections, the first panel section comprising first and second side edges, wherein the sixth panel section is joined to the third panel section along a third fold line and is joined to first side edge of the first panel section along a fourth fold line, and wherein the seventh panel section is joined to the fifth panel section along a fifth fold line and is joined to the second side edge of the first panel section along a sixth fold line. In addition, each of the sixth and seventh panel sections can include upwardly extending locking tabs. Also, the sixth panel section can include first and second cross member receiving slots that are positioned at opposite sides of the locking tab of the sixth panel section, and the seventh panel section can include first and second cross member receiving slots that are positioned at opposite sides of the locking tab of the seventh panel section.

In accordance with further embodiments, a container can comprise: a plurality of product supporting trays, the trays being spaced vertically apart from and overlying one another, and wherein each tray positioned above at least one other tray is an upper tray; the trays comprising at least three tray corners; a post positioned at and associated with each tray corner of each tray that is below an overlaying tray to support the overlaying tray; each post having an interior and an exterior and comprising a plurality of elongated vertical post panel sections, each post panel section having a respective upper and lower ends, the post panel sections comprising opposed first and second surfaces, the post panel sections including at least one face or first panel section, the first surface of the face panel section facing toward the interior of the post and the second surface of the face panel section facing away from the interior of the corner post, the post panel sections defining at least two interior post corners spaced from the associated tray corner and positioned interiorly of the first surface of the face panel section. The container can also comprise an elongated cross member having first and second cross member end portions, the first cross member end portion overlying the interior post corners of one of the posts associated with one corner of the tray and the second cross member end portion overlying the upper ends of the interior post corners of another of the posts other than said one of the posts, said another of the posts being either associated with a corner of the tray other than said one corner of the tray or a post spaced from the tray corners. A plurality of cross members are desirably included in the container.

In accordance with further aspects of embodiments of a container, the container can have post panel sections of a structure that comprises second and third panel sections joined together by a fold line at a first of the interior corners, and fourth and fifth panel sections joined together by a fold line at a second of the interior corners. The second and fourth panel sections can abut the interior surface of the face panel section and the third and fifth panel sections can abut one another and extend away from the interior surface of the face panel section.

As still further aspects of container embodiments, at least the face panel section and second panel section can include respective aligned cross member receiving slots. In addition, the cross member can comprise a first leg portion positioned within the cross member receiving slots and a second leg portion overlying the upper ends of the interior corners and the upper ends of the third and fifth panel sections.

As still further aspects of an embodiment, a container can be rectangular and with tray corners that are ninety degree corners. Also, the post panel sections can be of a structure comprising: sixth and seventh panel sections, the sixth panel section being joined to the face panel section along a vertical fold line to form a first exterior post corner, the sixth panel section being joined along a vertical fold line to the third panel section to form a portion of a second exterior corner of the post, the second exterior corner of the post being positioned adjacent to the associated tray corner, the seventh panel section being joined to the face panel section along a vertical fold line to form a third exterior post corner, the seventh panel section being joined to the fifth panel section along a vertical fold line to form a portion of the second exterior corner of the post, the first post corner, the second post corner and the third post corner forming a post with a triangular horizontal cross section with the exterior of the face panel section facing toward the center of the container.

DETAILED DESCRIPTION

In view of the many possible embodiments to which the principles of the disclosed invention may be applied, it should be recognized that the illustrated embodiments are only examples, and should not be taken as limiting the scope of the invention. All novel and non-obvious combinations and sub-combinations of elements described herein are within the scope of the invention.

Throughout this disclosure, when a reference is made to a first element being coupled to a second element, the term "coupled" is to be construed to mean both direct connection of the elements as well as indirect connection of the elements by way of one or more additional intervening elements. Also, the singular terms "a", "and", and "first", mean both the singular and the plural unless the term is qualified to expressly indicate that it only refers to a singular element, such as by using the phase "only one". Thus, for example, if two of a particular element are present, there is also "a" or "an" of such element that is present. In addition, the term "and/or" when used in this document is to be construed to include the conjunctive "and", the disjunctive "or", and both "and" and "or". Also, the terms "includes" and "has" have the same meaning as "comprises" and the terms "including" and "having" have the same meaning as "comprising". It should be noted that the posts described below can be used at corners or at other locations of a container. Also, differently constructed posts can be used at different locations, such as one form of post at corners of a container and other forms of posts at the center of a palletized container.

With reference to FIG. 1, a blank 10 is illustrated for use in forming one embodiment of a container post in accordance with this disclosure. Desirably, but not necessarily, the blank is a unitary single piece of corrugated board having one or more paper layers and one or more internal fluted core layers. In the embodiment of FIG. 1, the flutes of the core layers can, for example, extend in a vertical direction from a bottom edge to a top edge of the blank to provide added crush strength to the post when in use.

The illustrated blank comprises a body 12 having a bottom edge 14, a top edge 16, and first and second opposed side edges 18, 20. A vertical center line of the blank is indicated in FIG. 1 by the line 22. The illustrated blank 12 is provided with defined fold lines 22, 24, 26, 28, 30 and 32, such as by spaced apart perforations (perforations can be spaced apart cuts, scoring or combinations thereof that do not entirely sever the blank along the entire fold line) facilitate folding of the blank along the respective fold lines. Other fold lines described herein can be formed in the same manner.

The fold lines separate the blank into respective panel sections including, in FIG. 1, a central or face panel section 40. First and second side-forming panel sections 42, 44, are also formed, with one side edge 46 of panel section 42 abutting a side edge 48 of panel section 40 along fold line 28. In addition, one side edge 50 of panel section 44 abuts a side edge 52 of panel section 40 along fold line 26. Thus, panel sections 42 and 44 in this example are spaced apart from one another by a central or face panel section 40.

Panel sections 60, 62 are also included in this example and are positioned adjacent to the respective panel sections 42 and 44. A side edge 63 of panel section 60 is positioned adjacent to a side edge 64 of panel section 42 along fold line 30. In addition, a side edge 66 of panel section 62 is positioned adjacent to a side edge 68 of panel section 44 along fold line 24.

In addition, the illustrated blank 10 comprises respective outermost panel sections 70, 72. Panel section 70 has a side edge 74 positioned adjacent to a side edge 76 of panel section 60 with panel section 70 being foldable relative to panel section 60 along fold line 32. Also, panel section 72 comprises a side edge 78 positioned adjacent to a side edge 80 of panel section 62. Panel section 72 is foldable relative to the panel section 62 about fold line 22.

Figure 15:
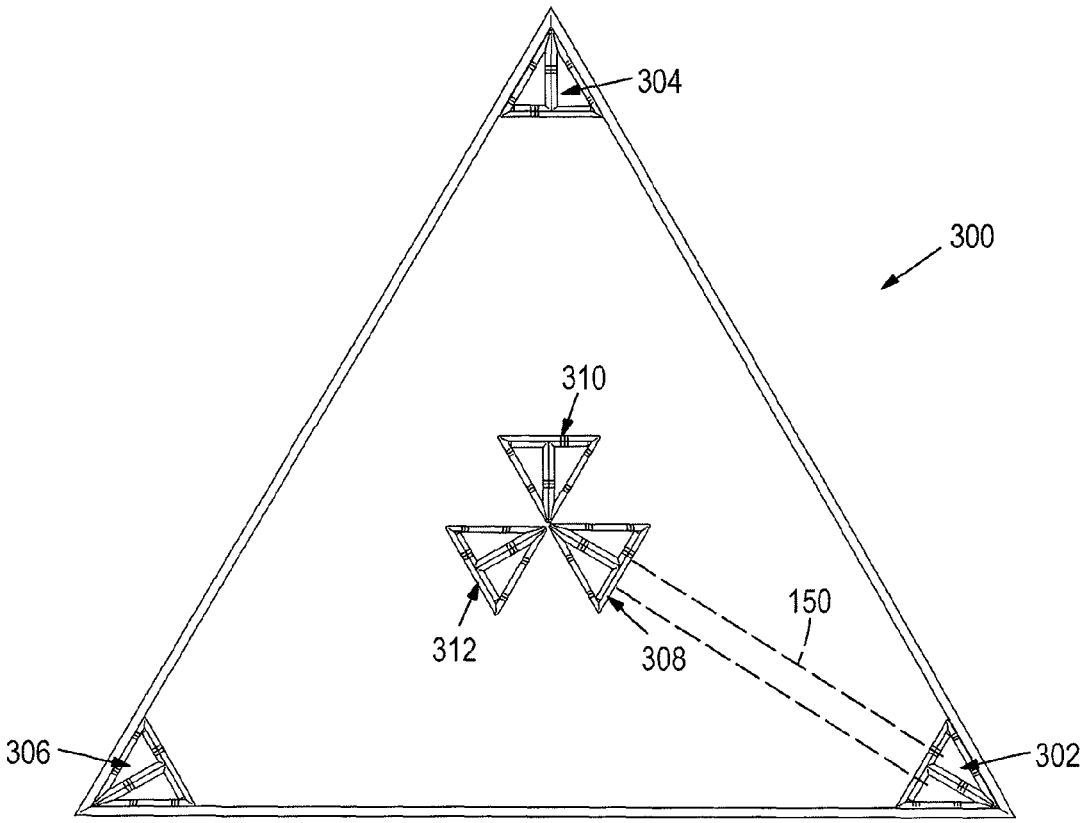
FIG. 15 is a top view of a lower three sided tray with triangular posts.
Figure 15A:
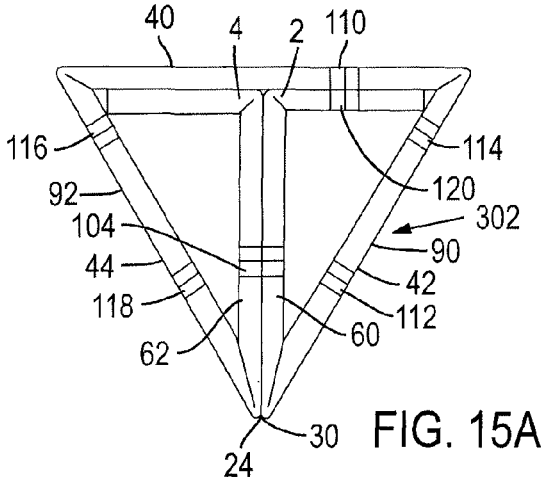
FIG. 15A is a top view of the individual post 302 of FIG. 15.

Depending upon the desired geometric configuration of the resulting post, more or fewer side sections can be included in the construction. The illustrated construction of FIG. 3 results in a post having a generally triangular cross section, which can be of a right triangular cross section (such as by having the angles between panel sections 42,60 and 44, 62 each being at forty five degrees). As a result, posts of this construction when positioned at the corners of a rectangular palletized container with face panel sections 40 facing the center of the container provides additional room for product in contrast to, for example, a post having a rectangular cross section having sides of a comparable width to the width of the sides of the post formed by blank 10. As another example, assuming a triangularly shaped container (see container or tray 300 in FIG. 15), the angles between panel sections 42, 60 and 44, 62 can be adjusted (such as to each be at sixty degrees to fit the corners of a triangularly shaped container). See posts 302-312 in FIG. 15, which are like the post of FIG. 3, but with the angles if the panels adjusted to fit the corners of the tray 300. In FIG. 15A, the same numbers have been used for components of the post 302 as used for the same components of the post of FIG. 3. Thus, these angles can be varied and can be different for corner posts than center posts.

Panel sections 42 and 44 include respective upwardly extending locking tab portions 90, 92 configured for insertion into slots formed in a tray located above such panel sections to detachably engage and lock the upper ends of the post formed from a blank 10 to a tray of a tier of the container positioned above the post. Corresponding cutout portions 94, 96 are positioned along the lower edge of the respective panel sections 42, 44. These cutout portions are voids formed when multiple blanks 10 are formed from a single piece of corrugated board, as the voids 94, 96 correspond in shape to the locking tab portions 90, 92 of another corner post blank. This assumes an example where multiple corner posts are being formed from the same piece of corrugated board. The voids 94, 96 provide space for receiving a respective locking tab 90 or 92 when the locking tab is inserted through a slot in a tray and projects above the tray. This facilitates positioning posts above another with a tray therebetween. The bottom ends of the posts can rest or float on the upper surface of the tray.

With further reference to FIG. 1, panel section 60 has a notch or cutout 97 along its upper edge and the panel section 62 has a similar cutout along its bottom edge. In addition, the panel section 60 has a first foldable locking tab 98 adjacent to its bottom edged and defined by slits 99, 100 and a fold line 101. A second foldable locking tab 104 is provided at a location adjacent to the upper or top edge of the panel section 62. The locking tab 104 is defined by slits 105, 106 and a fold line 107. The cutout 97 is positioned and configured to receive and be engaged by the locking tab 104 and the cutout 102 is positioned and configured to receive and engage the locking tab 98 when the post is assembled to retain the post in the assembled state without the need for adhesive, tape or other fastening mechanisms (although such fastening mechanisms can be used as an alternative or in addition to the locking tabs and cutouts). In the form shown, the locking tabs and cutouts are of a trapezoidal shape with the narrowest portion of the trapezoid being positioned furthest from the adjacent panel edge.

In addition, the exemplary panel section 40 comprises a first support member or cross member receiving slot 110 offset from the center line 22 of the blank 10. In addition, panel section 42 comprises first and second support member receiving slots 112, 114 positioned on opposite sides of the locking tab 90. Similarly, panel section 44 comprises first and second support member receiving slots 116, 118 positioned on opposite sides of the locking tab 92. A support member receiving slot 120 is also found at the upper edge of panel section 70. When the blank 10 is folded into a post as described below, selected support member receiving slots are aligned with one another and are positioned to receive a support member, such as a leg of an angular cross member or beam, when the palletized container structure is erected.

Figure 2:
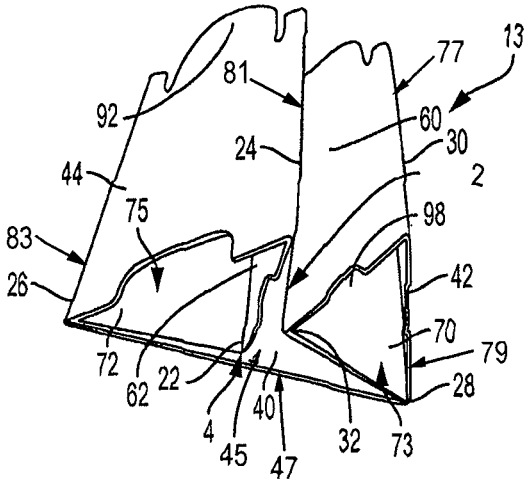
FIG. 2 is a perspective view of a partially completed post made from the blank of FIG. 1.
Figure 4:
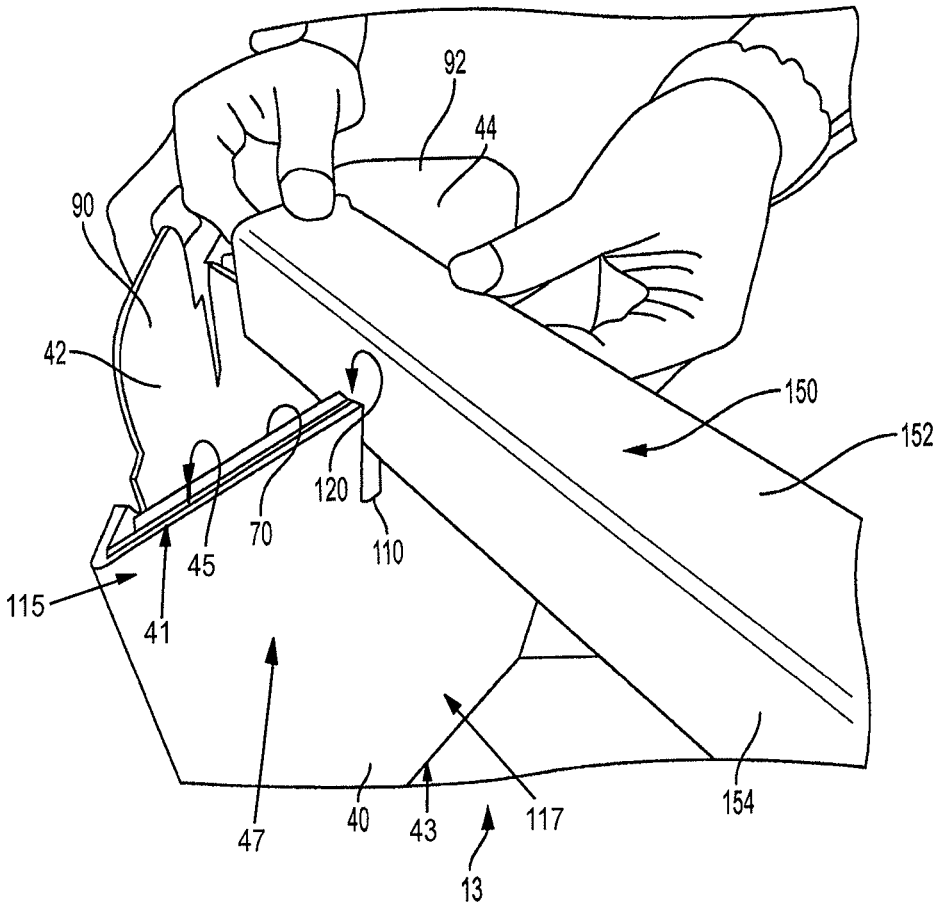
FIG. 4 illustrates the post of FIG. 3 with a tier supporting cross member or support shown positioned in a slot of the post and supported by two internal corners of the post; the support in this example comprising an angular support.

Referring to FIG. 2, the post blank 10 of FIG. 1 is shown partially assembled into a post 13 in this figure. The panel 40 has a first side 45 comprising a first side surface and a second side 47, opposed to the first side 45, and comprising a second side surface. In the embodiment of FIG. 4, the second side 47 and its side surface face inwardly. During assembly, the panel section 70 is folded to be positioned adjacent to an interior surface of panel section 40. In addition, panel section 72 is folded to be adjacent to the interior surface of panel section 40. Thus, panel sections 70 and 72, in combination with panel section 40, in effect double up the thickness of this particular portion of the post 13. In addition, panel section 60 is positioned adjacent to panel section 62, thereby doubling up the thickness of the center portion of the post. In addition, the corner 2 along fold line 32 between panel section 70 and panel section 60 is positioned adjacent to the corner 4 along fold line 22 between panel section 62 and panel section 72. Therefore, two corners are provided approximately in the center of the panel section 40 and provide added crush strength at this location for supporting a cross member or support from below. Corners 2, 4 are interior post corners positioned interiorly to the panel section 40 and interiorly to the panels forming the outer walls of the post 13. The dashed line 150 indicates a portion of a support member overlaying the corners 2, 4. One exemplary form of support member 150 is described below. The two corners 2, 4 in this embodiment abut one another when the post is fully assembled and are centrally positioned behind the panel section 40. Dashed line supports 150 are also shown in FIG. 15. With reference to FIG. 4, the panel section 40 has a first end 41 at the upper end of the post 13 and a second end 43 at the lower end of the post.

In FIG. 2, the locking tab 98 has not yet been moved to the position for folding into the notch 102 to engage the notch and hold the assembled post or rolled together panel sections together.

In effect, panel sections 70, 60 and 42 form a first tubular column or structure 73 behind panel section 40. In addition, panel sections 72, 62 and 44 form a second tubular column or structure 75 positioned behind panel section 70. Each of these tubular structures 73, 75 in the illustrated embodiment are triangular in cross section. This can also be seen in FIG. 11. If the tubular structures are formed from more than 3 panel sections, other geometric cross sectional shapes would be achieved, such as rectangular, hexagonal or otherwise. FIGS. 12 and 13 illustrate some alternative configurations that each result in a plurality of tubular structures behind the front panel section 40. In addition, in each of these examples, a plurality of corners are provided in proximity to the center of the front panel section 40 in a position to provide support for a support member positioned above such corners.

Figure 3:
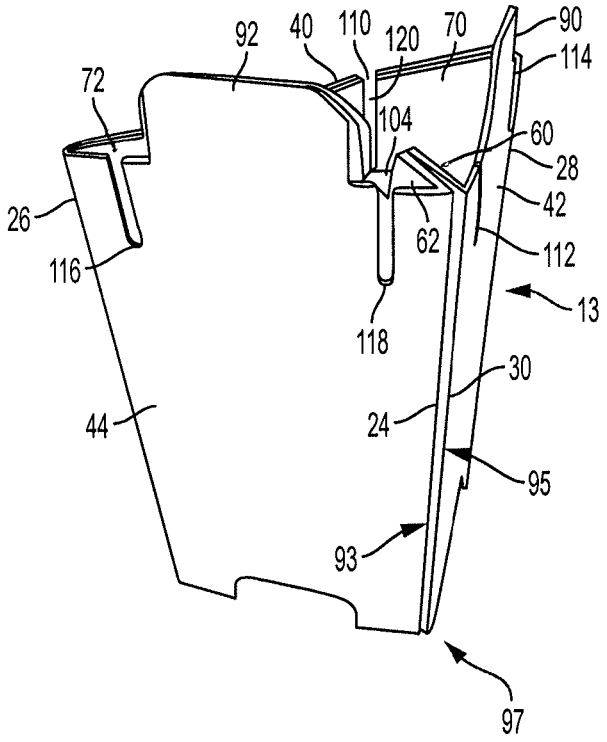
FIG. 3 is a perspective view of the resulting post formed by folding the blank of FIG. 1.

With reference to FIGS. 2-4, in this embodiment a post 13 for supporting trays of a container comprises a first or face panel section 40 having first and second ends 41,43 and first and second opposed sides 45,47. The first side 45 comprises a first side surface and the second side 47 comprises a second side surface. The post 13, comprises a first tubular structure 73 positioned at the first side 45 of the first panel section 40 and a second tubular structure 75 positioned at the first side 45 of the first panel section 40 and adjacent to the first tubular structure 73. The first tubular structure 73 comprises second (70) and third (60) panel sections that meet at a first corner 2, the first corner being positioned along a central portion of the first side 45 of the first panel section 40 and adjacent to the first side surface of the first side 45 of the panel section 40. In addition, the second tubular structure in this embodiment comprises fourth (72) and fifth (60) panel sections that meet at a second corner 4. The second corner 4 is positioned along a central portion of the first side 45 of the first panel section 40 and adjacent to the first side surface of the first side 45 of the first panel section 40. As can be seen in FIGS. 2 and 3, the third and fifth panel sections 60, 62 extend away from the first side surface of the first side 45 of the first panel section 40.

In FIGS. 2 and 3, the post 13 comprises the second and fourth panel sections 70, 72 abutting the first side surface of the first side 45 of the first panel section 40 and the third and fifth panel 60, 62 sections abutting one another.

With continued reference to FIGS. 2-4, the illustrated embodiment of a post 13 comprises the second panel section 70 joined to the third panel section 60 at the first corner 2 along a first fold line 32, the fourth panel section 72 is joined to the fifth panel section 62 at the second corner 4 along a second fold line 22. In addition this illustrated post 13 comprises sixth (42) and seventh (44) panel sections. The first panel section 40 comprises first and second side edges 48, 52 (FIG. 1). As best seen in FIG. 2, the sixth panel section 42 is joined to the third panel section 60 along a third fold line 30 at a third corner 77 and is joined to the first side edge 48 of the first panel section 40 along a fourth fold line 28 at a fourth corner 79. Also, the seventh panel section 44 is joined to the fifth panel section 62 along a fifth fold line 24 at a fifth corner 81 and is joined to the second side edge 52 of the first panel section 40 along a sixth fold line 26 at a sixth corner 83.

FIG. 4 shows a post 13 positioned in an upright orientation which is the position of the post when used to support containers/trays. In this orientation, the post 13 has an upper end 115 and a lower end 117. In addition, the first end 41 of the first panel section 40 is at the upper end 115 of the post when in this orientation. In FIG. 4, the sixth panel section 42 is shown with an upwardly extending locking tab 90 and the seventh panel section 44 is shown with an upwardly extending locking tab 92. As can be seen in FIG. 3, which also shows post 13 in an upright orientation, the sixth panel section 42 includes first and second cross member receiving slots 112, 114 positioned at opposite sides of the locking tab 90 of the sixth panel section 42. Also, the seventh panel section 44 includes first and second cross member receiving slots 116, 118 positioned at opposite sides of the locking tab 92 of the seventh panel section 44.

Figure 6A:
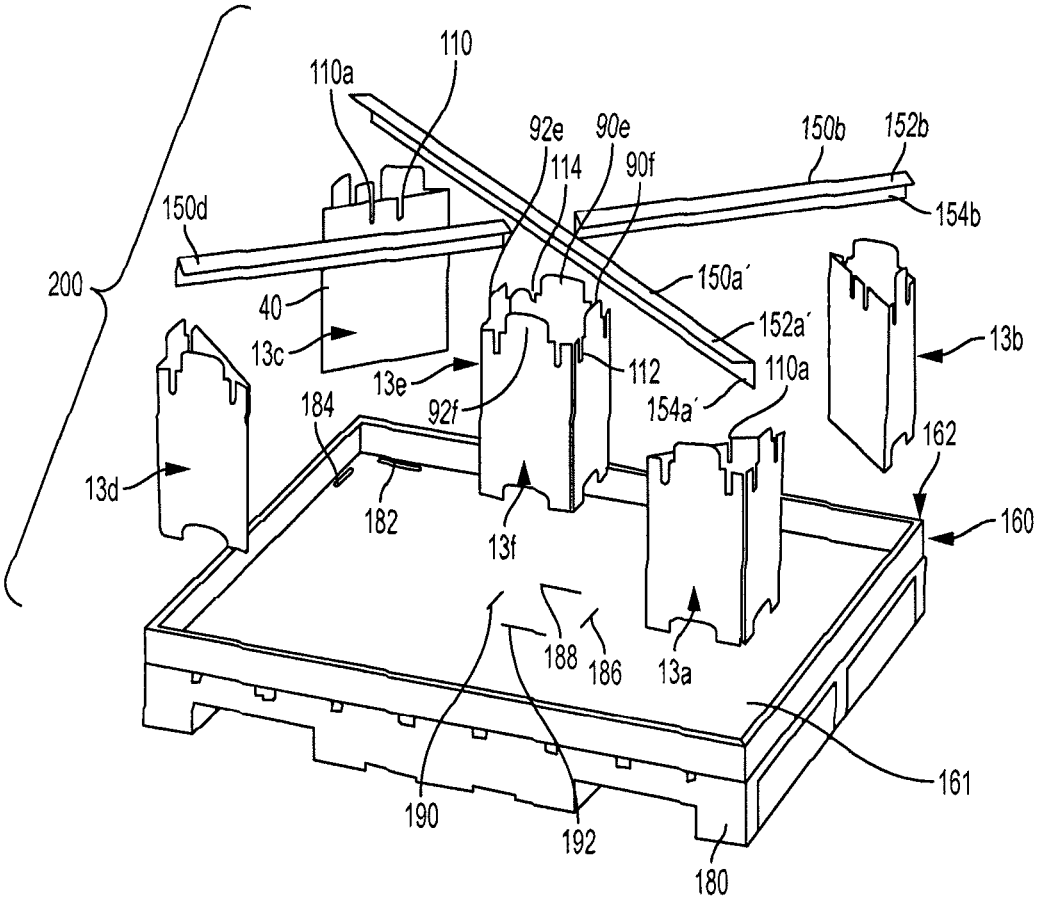
FIG. 6A is a view similar to FIG. 5, but showing the lower tray positioned on a pallet and also showing one of the supports for engaging respective opposed corner posts and spanning the entire distance between the engaged corner posts.
Figure 6B:
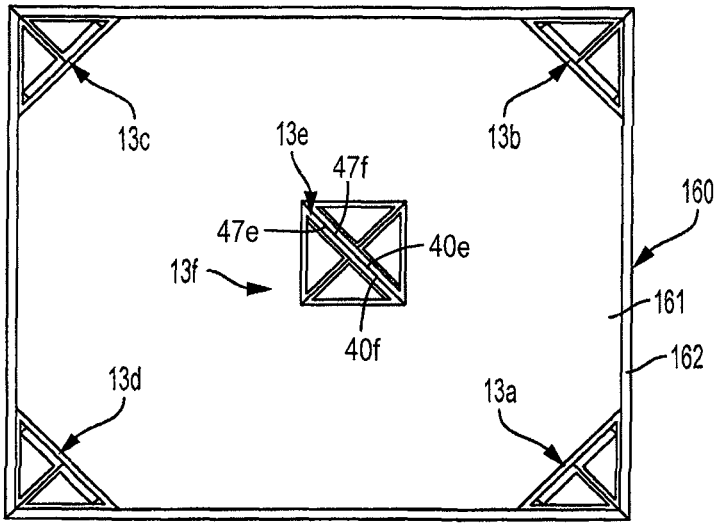
FIG. 6B is a top view of the lower tray with four corner posts and a center post.

With reference to FIG. 6B, a post positioned at the center of the illustrated construction comprises first and second posts 13, labeled as post 13*e* and 13*f* in FIG. 6B. As shown in FIG. 6B, the second side 47*e* of first panel 40*e* of post 13*e* is positioned against the second side 47*f* of first panel section 40*f* of the second post 13*f*.

Figure 11:
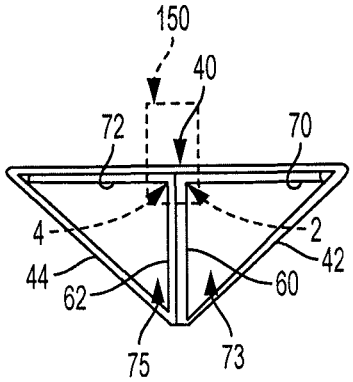
FIG. 11 is a horizontal cross sectional view of the post of FIG. 3 taken through the center of the post.
Figure 12:
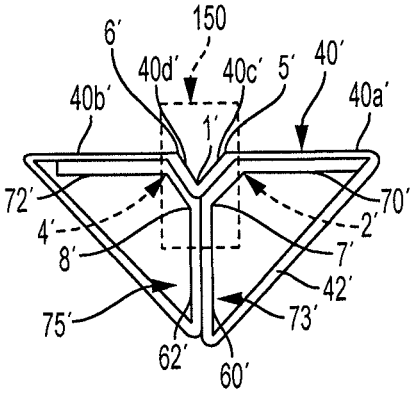
FIG. 12 is a horizontal cross sectional view through the center of an alternative form of a post.
Figure 13:
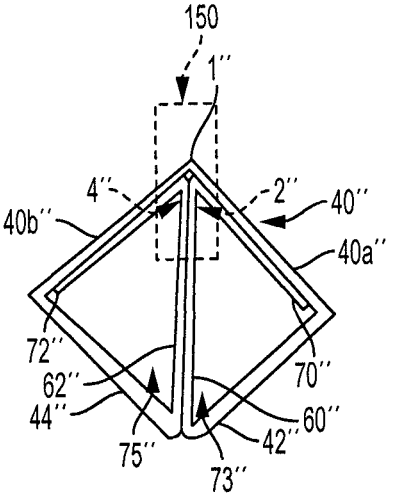
FIG. 13 is a horizontal cross sectional view through yet another alternative form of a post.

In FIG. 12, elements corresponding to those of FIG. 11 are assigned the same numbers with a "prime (')" designation and will not be discussed in detail. In the same manner, in FIG. 13, elements corresponding to those of FIG. 11 are assigned the same numbers with a "double prime (")" designation and will also not be discussed in detail.

In FIG. 12, the front panel section 40' has four subpanel sections 40*a*', 40*b*', 40*c*' and 40*d*'. The panel sections are folded to form a V-shaped region at a central portion of the panel section 40'. The front panel section 40' thus has corners 1', 5' and 6' with corner 1' being at the center of panel section 40' in this example. In FIG. 12, the panel sections 60' and 62' are folded to follow the contour of the front panel section 40'. Thus, in this example, panel section 60' has corners 2' and 7' positioned adjacent to or abutting the respective corners 5' and 1' of the front panel section. In the same manner, in this example, panel section 62' has corners 4' and 8' positioned adjacent to or abutting the respective corners 6' and 1' of the front panel section. A portion of a support member 150 is also shown by dashed lines in this figure. In FIG. 12, like the embodiment of FIG. 11, a plurality of corners are provided beneath the support member and behind the front panel section. In addition plural tubular support columns 73' and 75' are also provided in this example behind the panel section 40'. Support member receiving slots are also desirably provided in this alternative construction.

In FIG. 13, the front panel section 40" is comprised of two panel subpanel sections 40*a*" and 40*b*" that intersect at an angle 1", which can be at any desired angle, such as between 45 degrees and 135 degrees, with the illustrated angle 1" being at ninety degrees. In this example, although the angles can be varied, the corners 2" and 4" at the intersection of panels 60", 70" and 62", 72" respectively are at angles of about 45 degrees. The corners 2" and 4" desirably, although not necessarily, abut the corner 1". Again, two tubular structures 73" and 75" are provided behind panel subsection 40" and a plurality of corners underlay a support member 150". Support member receiving slots are also desirably provided in this alternative construction. The FIG. 13 construction can comprise a post of a generally rectangular cross section, such as of a square cross section. This is less advantageous and distinctly different from the construction of FIG. 11 which occupies far less of an assembled palletized container product receiving area and which still provides enhanced strength for supporting a support member and supported load from below. For enhanced crush strength purposes, it is desirable to position a plurality of two corners beneath cross members that are used to support a tier of a palletized package positioned above the post.

FIG. 3 illustrates the assembled post shown in FIG. 2. In this case, the fold tab or locking element 104 has been folded over and into the notch 97 and, although not shown in this figure, the fold tab 98 has been folded into the notch 102. As a result, the post is held together without requiring adhesive or tape. As can be seen in FIG. 3, in this example, the corners 93, 95 formed at respective fold lines 24 and 30 are positioned adjacent to one another to form an outer corner 97 of the post. The panel sections 42 and 44 in effect diverge or extend away from one another at a desired angle at this corner of the post.

In addition, as can be seen in FIG. 3, the cross member receiving slot 112 is aligned with the cross member receiving slot formed by slots 110 in panel 40 and 120 in panel 70. This alignment allows an angular cross member, or otherwise configured support, to have one leg or portion of the support inserted into these aligned slots with the other leg or portions of the support supported by the upper edges of panel sections 60 and 62 as well as the corners 2, 4 (see FIG. 11) formed at the intersection of panels 60, 70 and 62, 72. As a result, an extremely strong support structure is provided for overlying trays.

The locking tabs 90 and 92 shown in FIG. 3 can have chamfered or rounded edges to facilitate their insertion into receiving slots in a tray or base for a container tier placed above the post, typically if the post is not the uppermost post in an assembled plural tiered container.

FIG. 4 illustrates the post 13 shown with an exemplary cross member being coupled to the post. The cross member 150 in this example comprises a support beam that is angular and more specifically is of generally right angular cross section having legs 152 and 154. The leg 154 (or alternatively the leg 152) is inserted into the slot formed by slot 110 in panel 40 and slot 120 in panel 70. As previously explained, with this construction the leg portion 152 is supported by two corners (2, 4; FIG. 11) as well as the double panels provided by abutting panel sections 40, 70; 40, 72 and 60, 62.

Figure 5:
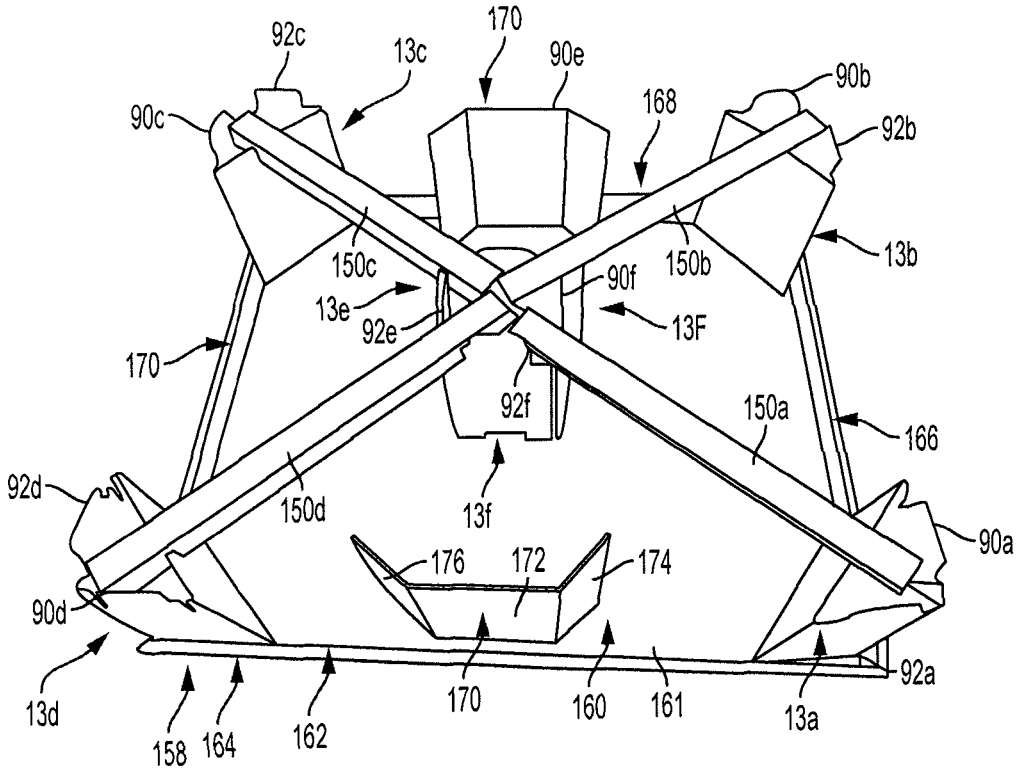
FIG. 5 illustrates an embodiment showing an exemplary tier of a palletizable container comprising one tray or base assembly with four posts in accordance with FIG. 3 positioned at the respective corners of the tray, in this case the tray being rectangular.

FIG. 5 illustrates an exemplary construction showing one tier of a palletizable container. The illustrated tier of FIG. 5 comprises a tray or base 160. In FIG. 5 the tray has a peripheral edge 162 projecting upwardly from the tray. In this illustrated example, the tray is shown as a square tray, although the tray can be rectangular or of other configurations. The perimeter 162 can be comprised of edge or peripheral assembly portions 164, 166, 168 and 170 projecting upwardly from a base portion 161 of the tray, such as explained in connection with FIG. 9 below.

In the example shown in FIG. 5, four of the posts 13*a*, 13*b*, 13*c* and 13*d* are positioned at corners of the tray and thus comprise corner posts of the assembly. In addition, a center post is also provided in this construction. Also, although a center post of a different configuration than the corner posts can be used, construction is simplified in the illustrated example by providing a center post comprising or consisting of two of the corner posts, indicated at 13*e* and 13*f* in FIG. 5. Cross members 150*a*, 150*b*, 150*c* and 150*d* extend from engagement with the respective corner posts 13*a*, 13*b*, 13*c*, and 13*d* to and into engagement with the center post. Respective slots of these posts receive a leg of the respective cross members. Reinforcing elements 170, which are optional, can be used for added strength during product shipment. Exemplary posts 170 are shown along two opposed sides of the container at respective intermediate locations between posts 13*a*, 13*d* and 13*b*, 13*c*. The illustrated reinforcements or vertical braces 170 can comprise, for example, a base panel portion 172 with wing (side) portions 174,176 that project at an angle from the base portion. Similar reinforcing elements can also be provided at locations between the corner posts along the other sides of the illustrated tray.

FIG. 6A illustrates a tier 200 of a palletized container which is like the tier shown in FIG. 5. In FIG. 6 the tray 160 is shown positioned on a pallet 180. In the embodiment of FIG. 6, the panel sections 40, such as numbered and indicated for the panel 40 of post 13*c*, can be provided with two slots, namely the slot 110 as previously described and a second slot 110*a* on the opposite side of the vertical centerline of panel section 40*d* from slot 110 and the same distance from the center line as the slot 110. In addition, the panel section 72 can also be provided with a slot like slot 120 of panel section 70. Also, the reinforcing elements 150*a* and 150*c* in FIG. 5 have been replaced with a single elongated reinforcing element 150*a*' of a length that extends from corner post 13*a* to corner post 13*c* with portions of the ends of the cross member 150*a*' being coupled to the respective corner posts, such as previously described. In the construction shown, the leg 154*a*' of cross member 150*a*' can be inserted into slot 110*a* (and into the aligned slot 120 in the panel section 70) of corner post 13*a*, a slot 112 of post 13*f*, a center slot formed by slots 110 and 120 of both posts 13*f* and 13*e*, a slot 114 of post 13*f* and into slots 110 and 120 in panel sections 40, 72 of post 13*c*. With this construction, the cross member 150*a* spans the distance between the post 13*a* and 13*c* with shorter cross members 150*b* and 150*d* extending between the respective center posts and corner posts 13*b* and 13*d*.

As is apparent from FIG. 6A, the posts 13*a* through 13*f* can in effect be floating posts in that they can simply rest on the upper surface of the central portion 161 of tray 160. Alternatively, they may be fastened in place. The central portion 161 of tray 160 can be provided with locking tab receiving through slots. In the illustrated embodiment, a pair of such tab receiving slots 182 and 184 are positioned at each of the corners of the tray and positioned at a location to receive the locking tabs 90 and 92, inserted from below, of an associated post located below the tray 160, assuming the tray is not the lowest tray in the assembly. In addition, a plurality of centrally positioned locking tab receiving through slots 186, 188, 190 and 192 can be provided, such as generally at the center of the tray portion 161, for receiving the locking tabs of 90, 92 of the associated posts forming the center post assembly and positioned below these slots, with the locking tabs being inserted through these slots from the posts below. Thus, when assembled in this particular embodiment, each tier is interlocked with the tier above by the locking tabs. In alternative constructions, the posts can be secured, such as by adhesive or other fasteners to overlaying trays as well as to the supporting tray.

FIG. 6B illustrates the tray 160 with corner posts 13*a*-13*d* and a central post comprised of two corner posts 13*e*, 13*f* positioned back to back at a location spaced from the sides of tray 160 and more desirably at the center of the tray. A horizontal section has been taken through the posts and below the upper ends of the posts in this view and for this reason slots and tabs at the upper ends of the posts are not visible.

Figure 7:
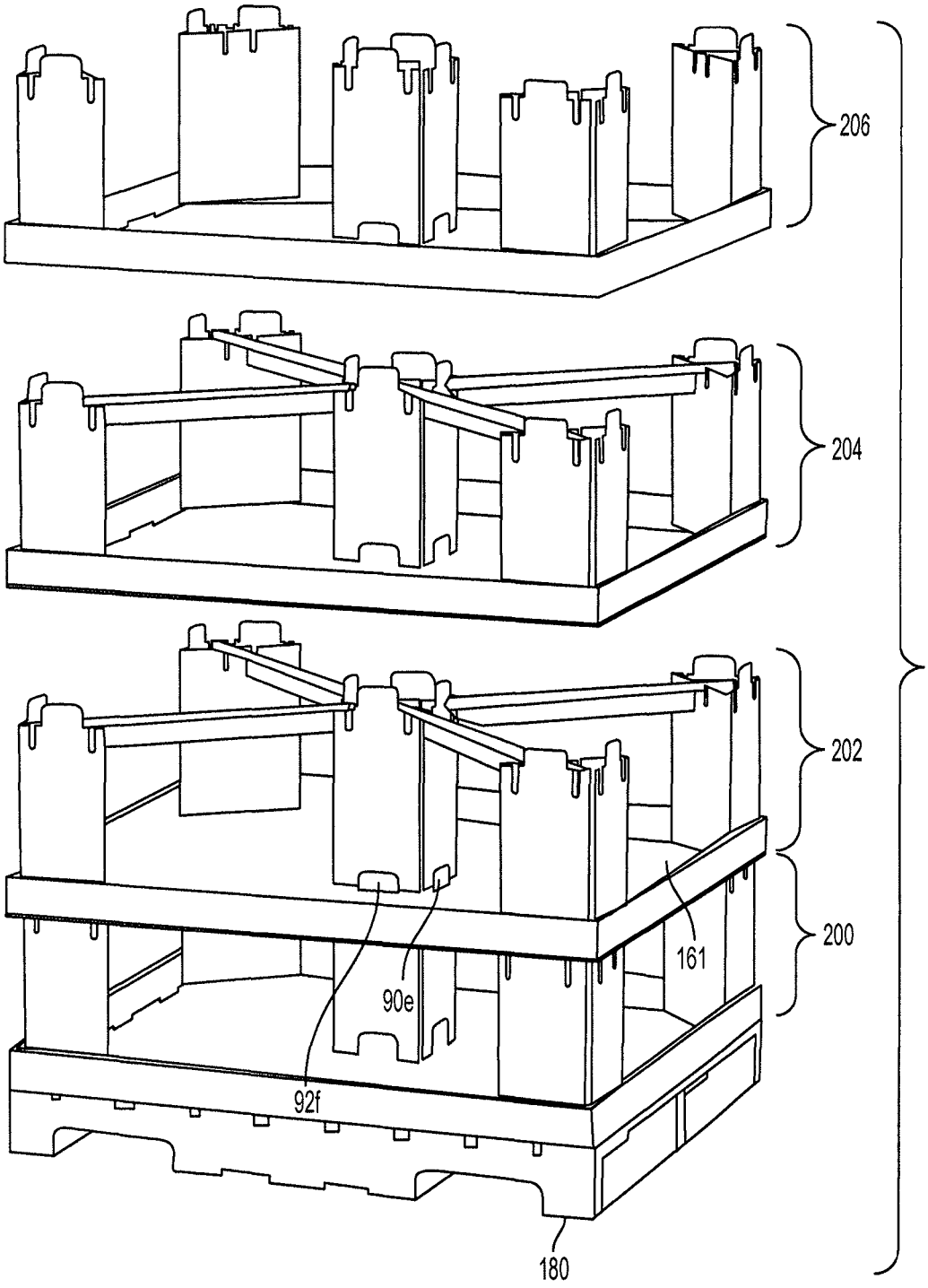
FIG. 7 illustrates a partially assembled palletizable container showing multiple tiers or layers with corner posts and a center post positioned on each of the trays of the tiers.

FIG. 7 illustrates a palletizable container having a plurality of the tiers indicated respectively at 200, 202, 204 and 206. Although the tiers can be of different constructions, desirably each of their tiers can be identical to the tier 200 described in FIG. 6. FIG. 7 shows locking tabs 90*f* and 92*f* from the posts below tier 202 inserted through the tab receiving slots at the central portion 161 of the tray 160 of tier 202. The tabs 90*f*, 92*f* as well as the tabs 90*e* and 92*e*, in this example, can project above the surface of the above tray portion 161 and can be positioned to abut and engage adjacent outer surfaces of outer wall panel sections of the posts of the above tier to assist in retaining the posts 13*e* and 13*f* or the above tier in place. Similarly, the locking tabs from the corner posts below a tier can project above the upper surface of the above tray portion 161 and can be positioned to engage and assist in retaining the corner posts of the above tier in position.

Figure 8:
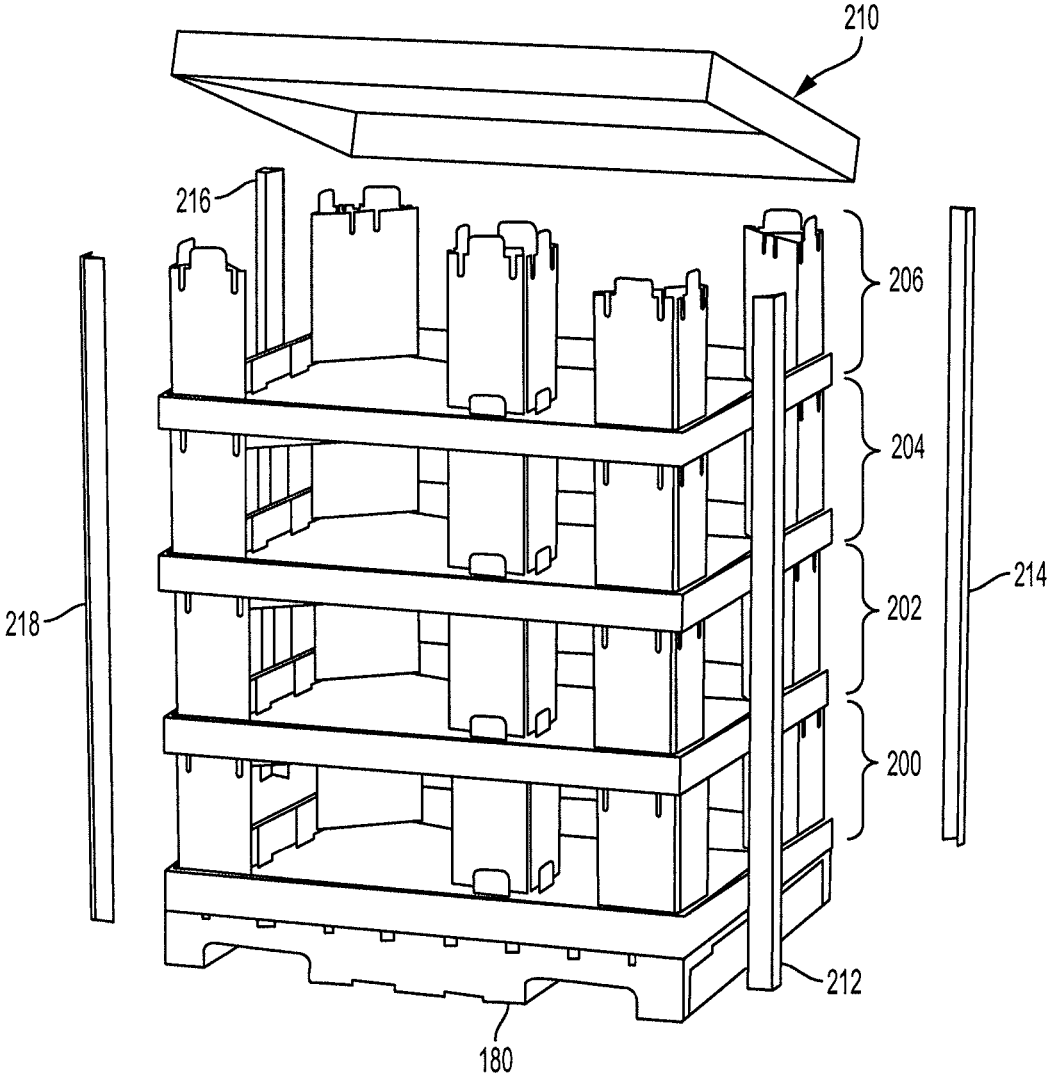
FIG. 8 illustrates a partially assembled palletized container formed with such posts and also showing an exemplary cap or cover element. Four optional corner reinforcements are shown for use in providing additional support at the corners of the container during, for example, shipment.

FIG. 8 illustrates the container assembly of FIG. 7 in an assembled state, except that a cap or cover portion 210 is shown above the container assembly for convenience and that can be provided to overlay the uppermost posts of the assembled container. FIG. 8 illustrates alternative reinforcements that can be used (instead or in addition to the reinforcements 170 shown in FIG. 5). These reinforcements are indicated at 212, 214, 216, and 218 and, in this example, comprise angular corner vertical braces that can be temporarily secured (such as by container wrapping to the assembled and product containing container) to provide additional vertical support for palletized containers stacked above the assembled tiered container of FIG. 8, such as during shipment and storage.

Figure 9:
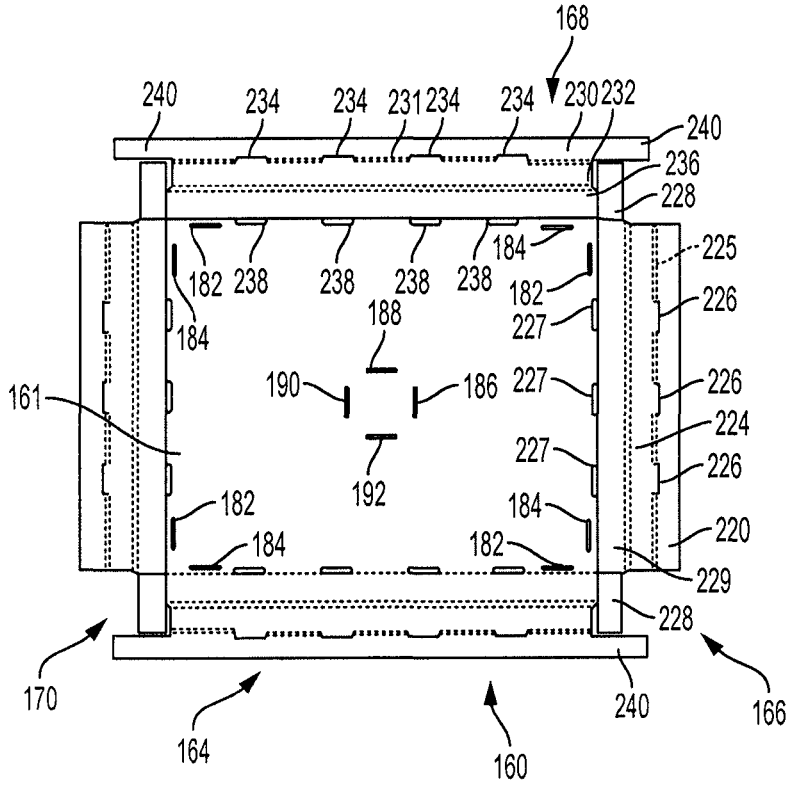
FIG. 9 illustrates an exemplary blank for forming one form of a tray utilizable in the container.

FIG. 9 illustrates an exemplary blank for forming an exemplary tray 160. The blank can be of paper board, such as corrugated paper board with one or more paper board layers and one or more fluted core layers between paper board layers. The corner post locking tab receiving slots adjacent to the corners of tray 160 in FIG. 9 are indicated at 182 and 184 at each of the corners of the tray. The right and left side peripheral rim forming assemblies 166, 170 of the tray 160 can be identical and for this reason only the right side peripheral forming elements 166 will be described below. In this example, the right side perimeter is formed by folding a strip 220 against a strip 224 along a fold line 225. Cuts are provided along the fold line to provide projecting tabs, indicated at 226, following folding of the strip 220 against the strip 224. The folded strips 220, 224 are folded against a strip 229 with the tabs 226 then being inserting into slots 227 provided in the central surface 161 of the tray to provide an assembled peripheral rim 166 at this particular side of the tray. In addition, fold tabs 228 at the ends of strip 229 can be folded inwardly for interlocking with the periphery forming structures 168, 164 at the respective top and bottom of the tray (top and bottom being with reference to FIG. 9). The top and bottom peripheral structures 168, 164 of the tray shown in FIG. 9 can be identical and hence only the top peripheral forming structure 168 will be described in detail. In this embodiment a strip 230 is folded about a fold line 231 against a strip 232. Locking tabs 234 are provided by cuts along the fold line 231. The folded strips 230, 232 are folded against a strip 236 and the locking tabs 234 are inserted into slots 238 in the tray portion 161 to provide the perimeter 168 of the tray at this location. In addition, the tray can be locked together by fold tabs 240 positioned in respective openings formed at the end of the folded strip 220, 224 and 229 in combination with the fold tabs 228 inserted into openings formed by the folded strips 230, 234 and 236. Thus, the exemplary blank performing the tray 160 shown in FIG. 9 can be used to provide an extremely strong tray 160 for use in the palletized container.

Figure 10:
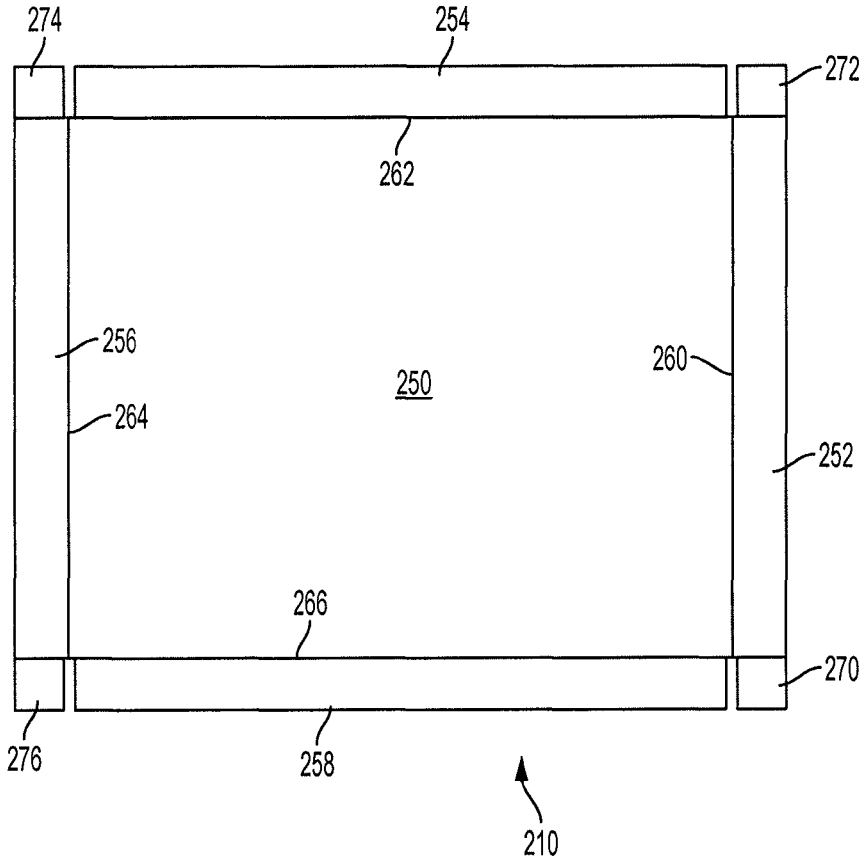
FIG. 10 illustrates an exemplary blank for use in forming the cap piece shown in FIG. 8.

FIG. 10 shows an exemplary blank, such as of paper board like the blank for the tray, for use in constructing the cover or cap portion to 10. This blank comprises a central section 250 with respective side strips 252, 254, 256 and 258 joined to the central portion along respective fold lines 260, 262, 264 and 266. The side strips 252, 254, 256 and 258 can be folded along the respective fold lines with fold tabs indicated at 270, 272, 274, and 276 then being folded over the respective strips 254, 256 and taped or otherwise secured together to form the cover. Alternative forms of cover elements can be used.

Figure 14:
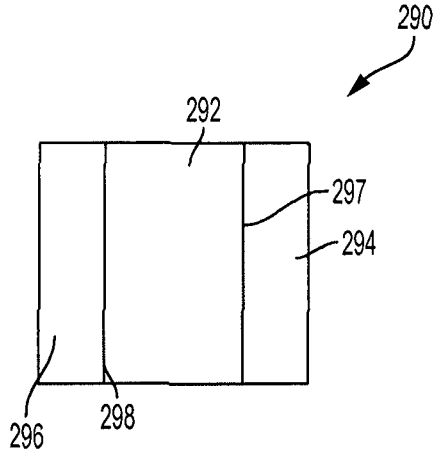
FIG. 14 is a plan view of a blank for making an optional vertical support, a plurality of which can be used between trays for reinforcing the structure against vertical loads.

FIG. 14 illustrates a unitary blank 290 for forming optional reinforcements such as 170 (FIG. 5) that can be used in the construction between trays. The blank 290 has a central panel 292 and side panels 294, 296. Respective vertical fold lines 297, 298 are positioned between the side panels 294, 296 and the center panel. In use, these side panels can be folded to project at right angles (or some other angle as in FIG. 5) from the central panel. The width of the central panel can vary and can be set to be slightly greater than the width of the packaged product (e.g., potato chip bags) to be placed in the tray. The side panels are then inserted between adjacent packages when the reinforcement is used.

Having described the palletized container and associated posts in connection with a number of embodiments, it should be apparent that those with ordinary skill in the art that the arrangements and configurations can be modified in arrangement in detail without departing from the advantaged principles disclosed herein. All such modifications fall within the scope of this disclosure.

We claim:

1. A post for supporting a tray of a container comprising:
a first panel section having first and second ends, first and second side edges, and first and second opposed sides, the first side comprising a first side surface and the second side comprising a second side surface;
a first tubular structure positioned at the first side of the first panel section;
a second tubular structure positioned at the first side of the first panel section and adjacent to the first tubular structure;
the first tubular structure comprising second and third panel sections that meet at a first corner, the first corner being positioned along a central portion of the first side panel section and adjacent to the first side surface of the first panel section;
the second tubular structure comprising fourth and fifth panel sections that meet at a second corner, the second corner being positioned along a central portion of the first side of the first panel section and adjacent to the first side surface of the first panel section and wherein the third and fifth panel sections extend away from the first side surface of the first panel section; and
wherein the third and fifth panel sections do not have notches spaced apart along their length.

2. A post according to claim 1 wherein the first and second tubular structures are each triangular in transverse cross section.

3. A post according to claim 2 wherein the second panel section is joined to the third panel section at the first corner along a first fold line, the fourth panel section is joined to the fifth panel section at the second corner along a second fold line, the post comprising sixth and seventh panel sections, the first panel section comprising first and second side edges, the sixth panel section being joined to the third panel section along a third fold line at a third corner and being joined to the first side edge of the first panel section along a fourth fold line at a fourth corner, and the seventh panel section being joined to the fifth panel section along a fifth fold line at a fifth corner and being joined to the second side edge of the first panel section along a sixth fold line at a sixth corner and wherein the third and fifth fold lines do not have notches spaced apart along their length.

4. First and second posts according to claim 3 positioned with the second side of the first panel section of the first post positioned against the second side of the first panel section of the second post.

5. A post according to claim 3 wherein the post has an upper end and a lower end when the post is in an upright orientation, the first end of the first panel section being at the upper end of the post when in the upright orientation, each of the sixth and seventh panel sections including upwardly extending locking tabs.

6. A post according to claim 5 wherein the sixth panel section includes first and second cross member receiving slots positioned at opposite sides of the locking tab of the sixth panel section, and wherein the seventh panel section includes first and second cross member receiving slots positioned at opposite sides of the locking tab of the seventh panel section.

7. A post according to claim 1 formed of a single unitary sheet of corrugated paperboard.

8. A post for supporting trays of a container comprising:
a first panel section having first and second ends, first and second side edges, and first and second opposed sides, the first side comprising a first side surface and the second side comprising a second side surface;
a first tubular structure positioned at the first side of the first panel section;
a second tubular structure positioned at the first side of the first panel section and adjacent to the first tubular structure;
the first tubular structure comprising second and third panel sections that meet at a first corner, the first corner being positioned along a central portion of the first side panel section and adjacent to the first side surface of the first panel section; and
the second tubular structure comprising fourth and fifth panel sections that meet at a second corner, the second corner being positioned along a central portion of the first side of the first panel section and adjacent to the first side surface of the first panel section and wherein the third and fifth panel sections extend away from the first side surface of the first panel section; and
comprising at least one cross member receiving slot in the first end of the first panel section and at least one cross member receiving slot in the second panel section, the cross member receiving slots being aligned and positioned so as to be adapted to receive one leg portion of an angular cross member having first and second leg portions with the second leg portion of the cross member overlaying and being supported by the first and second corners and the third and fifth panel sections.

9. A post according to claim 8 wherein the second and fourth panel sections each abut the first side surface and the third and fifth panel sections abut one another.

10. First and second posts according to claim 8 positioned with the second side surface of the first panel section of the first post against the second side surface of first panel section of the second post.

11. A post for supporting trays of a container comprising:
a plurality of elongated panel sections, the post having an interior and an exterior, each panel section having respective upper and lower ends when the post is in an upright orientation, the panel sections also comprising first and second side edges and opposed first and second sides, the panel sections including at least one first panel section, the first side of the first panel section facing toward the interior of the post and the second side of the first panel section facing away from the interior of the post, the panel sections forming at least first and second interior post corners positioned interiorly of the first side of the first panel section;

the panel sections comprising second and third panel sections, one of the first and second side edges of the second panel section meeting one of the first and second side edges of the third panel section at the first interior post corner; the panel sections comprising fourth and fifth panel sections, one of the first and second side edges of the fourth panel section meeting one of the first and second side edges of the fourth panel section at the second interior post corner; and wherein the second and fourth panel sections are each positioned adjacent to the first side of the first panel section and the third and fifth panel sections extend away from the first side of the first panel section; and further comprising at least one cross member receiving slot in the upper end of the first panel section and at least one cross member receiving slot in the upper end of the second panel section, the cross member receiving slots being aligned and positioned so as to be adapted to receive one leg portion of an angular cross member having first and second leg portions with the second leg portion of the cross member overlaying and being supported by the first and second corners and the third and fifth panel sections.

12. A post according to claim 11 wherein the first interior post corner is positioned along a central portion of the first side of the first panel section, and wherein the second interior post corner is positioned along a central portion of the first side of the first panel section.

13. A post according to claim 12 wherein the second and fourth panel sections abut the first side of the first panel section and the third and fifth panel sections abut one another; and wherein the second panel section is joined to the third panel section along a first fold line, wherein the second and third panel sections are folded at the first fold line to form the first interior post corner, the fourth panel section is joined to the fifth panel section along a second fold line, wherein the fourth and fifth panel sections are folded at the second fold line to form the second interior post corner, the post comprising sixth and seventh panel sections, the first panel section comprising first and second side edges, wherein the sixth panel section is joined to the third panel section along a third fold line and is joined to first side edge of the first panel section along a fourth fold line, and wherein the seventh panel section is joined to the fifth panel section along a fifth fold line and is joined to the second side edge of the first panel section along a sixth fold line.

14. A post according to claim 13 wherein each of the sixth and seventh panel sections include upwardly extending locking tabs.

15. A post according to claim 14 wherein the sixth panel section includes first and second cross member receiving slots that are positioned at opposite sides of the locking tab of the sixth panel section, and wherein the seventh panel section includes first and second cross member receiving slots that are positioned at opposite sides of the locking tab of the seventh panel section.

16. A post according to claim 11 formed of a single unitary sheet of corrugated paperboard.

17. A container comprising:

a plurality of product supporting trays, the trays comprising a bottom tray and upper trays positioned above the bottom tray, each upper tray overlaying at least one other of said trays, the trays being spaced vertically apart from one another;

the trays comprising at least three tray corners;

a post positioned at and associated with each tray corner of each tray that is below an overlaying upper tray to support the overlaying upper tray;

each post having an interior and an exterior and comprising a plurality of elongated vertical post panel sections, each post panel section having a respective upper and lower ends, the post panel sections comprising opposed first and second surfaces, the post panel sections including at least one face panel section, the first surface of the face panel section facing toward the interior of the post and the second surface of the face panel section facing away from the interior of the corner post, the post panel sections defining at least two interior post corners spaced from the associated tray corner and positioned interiorly of the first surface of the face panel section;

a cross member having first and second cross member end portions, said posts including a first post associated with a first tray corner and a second post associated with a second tray corner, the first cross member end portion overlying the interior post corners of the first post and the second cross member end portion overlying the upper ends of the interior post corners of the second post.

18. A container according to claim 17 wherein the post panel sections comprise second and third panel sections joined together by a fold line at a first of the interior corners, and wherein the post panel sections comprise fourth and fifth panel sections joined together by a fold line at a second of the interior corners, the second and fourth panel sections abutting the first surface of the face panel section and the third and fifth panel sections abutting one another and extending away from the first surface of the face panel section.

19. A container according to claim 18 wherein at least the face panel section and second panel section include respective aligned cross member receiving slots, the cross member comprising a first leg portion positioned within the cross member receiving slots and a second leg portion overlaying the upper ends of the interior corners and overlaying the upper ends of the third and fifth panel sections.

20. A container according to claim 17 including a center post comprising a combination of first and second posts as set forth in claim 17 positioned at a location spaced from the tray corners, wherein the first and second posts are positioned with the exterior surface of the face panel section of the first post facing the exterior surface of the face panel section of the second post to thereby form the center post.

21. A container according to claim 20 wherein the container is rectangular and the tray corners are ninety degree corners, the post panel sections comprise sixth and seventh panel sections, the sixth panel section being joined to the face panel section along a vertical fold line to form a first exterior post corner, the sixth panel section being joined along a vertical fold line to the third panel section to form a portion of a second exterior corner of the post, the second exterior corner of the post being positioned adjacent to the associated tray corner, the seventh panel section being joined to the face panel section along a vertical fold line to form a third exterior post corner, the seventh panel section being joined to the fifth panel section along a vertical fold line to form a portion of the second exterior corner of the post, the first post corner, the second post corner and the third post corner forming a post with a triangular horizontal cross section with the exterior of the face panel section facing toward the center of the container.

22. A container comprising:

a plurality of product supporting trays, the trays comprising a bottom tray and upper trays positioned above the bottom tray, each upper tray overlaying at least one other of said trays, the trays being spaced vertically apart from and overlying one another;

the trays comprising a plurality of corners;

a respective post positioned at and extending upwardly from each tray corner of each tray that is below an overlaying tray to support the overlaying tray;

each post having an interior and an exterior and comprising a plurality of elongated vertical post panel sections, each post panel section having a respective upper and lower ends, the post panel sections comprising opposed first and second surfaces, the post panel sections including at least one face panel section, the first surface of the face panel section facing toward the interior of the post and the second surface of the face panel section facing away from the interior of the post, the post panel sections defining at least two interior post corners spaced from the associated tray corner and positioned interiorly of the first surface of the face panel section; and a cross member having an end portion that overlays the interior post corners of at least one of the posts.

23. A container according to claim 22 wherein the trays have four corners.

24. A container according to claim 23 wherein there are two of said posts positioned at the center of and extending upwardly from each of the trays that is below an overlaying tray, and wherein there are a plurality of cross members having first and second end portions, the interior corners of each post being overlayed by an end portion of a cross member, the cross members extending from a corner post at least to one of the center posts.

* * * * *